United States Patent [19]

Seimiya et al.

[11] Patent Number: 4,760,422

[45] Date of Patent: Jul. 26, 1988

[54] DEVELOPING DEVICE USING SINGLE COMPONENT TONER

[75] Inventors: Ryubun Seimiya, Hino; Noriyoshi Tarumi, Hachioji; Hiromi Demizu, Yokohama; Makoto Obu, Tokyo; Hidetoshi Yano, Yokohama, all of Japan

[73] Assignee: Ricoh Company, Ltd., Tokyo, Japan

[21] Appl. No.: 818,793

[22] Filed: Jan. 14, 1986

[30] Foreign Application Priority Data

| | | | |
|---|---|---|---|
| Jan. 16, 1985 | [JP] | Japan | 60-4045 |
| Jan. 16, 1985 | [JP] | Japan | 60-2321 |
| Jan. 24, 1985 | [JP] | Japan | 60-9821[U] |
| Jan. 28, 1985 | [JP] | Japan | 60-15201 |
| Jan. 31, 1985 | [JP] | Japan | 60-17180 |
| Jan. 31, 1985 | [JP] | Japan | 60-17183 |

[51] Int. Cl.[4] ..... G03G 15/08

[52] U.S. Cl. ..... 355/3 DD; 118/656

[58] Field of Search ..... 355/3 DD, 14 D; 118/261, 653, 656–658

[56] References Cited

U.S. PATENT DOCUMENTS 4,421,057 12/1983 Hosono et al. ..... 118/657

4,445,771 5/1984 Sakamoto et al. ..... 118/657 X

FOREIGN PATENT DOCUMENTS 59-126567 7/1984 Japan ..... 355/3 DD

*Primary Examiner*—Arthur T. Grimley

*Assistant Examiner*—Joan Pendegrass

*Attorney, Agent, or Firm*—Cooper & Dunham

[57] ABSTRACT

A device for developing an electrostatic latent image includes a developing sleeve and a sponge roller which is in scrubbing contact with the sleeve. Thus, even if non-magnetic, single component toner is used, it is electrically charged due to the scrubbing action and thus electrically attracted to the developing sleeve. A doctor blade is pressed against the developing sleeve and thus the toner is formed into a thin film having sufficient charge and a predetermined thickness. As the developing sleeve further rotates, thus formed thin film is brought to a developing region where the latent image is developed by the thin film of toner. Preferably, the blade is arranged in a particular orientation with respect to the sleeve. The blade may be movably provided so as to be pressed against the sleeve by an appropriate biasing element. The sleeve and the sponge roller may be driven to rotate same or opposite in direction, as desired. The sleeve may be formed to be elastically deformable. The sleeve may be set in oscillation. The blade is preferably comprised of a copolymer of ethylene and tetrafluoroethylene.

10 Claims, 12 Drawing Sheets

DEVELOPING DEVICE USING SINGLE COMPONENT TONER

BACKGROUND OF THE INVENTION

1. Field of the Invention

This invention generally relates to a device for developing an electrostatic latent image, and in particular, to a developing device using a single component developer. More specifically, the present invention relates to a developing device which is particularly suitable for use with a non-magnetic, single component developer.

2. Description of the Prior Art

In the dry-type development method, which is applied in various imaging apparatuses, such as electrophotographic copiers and electrostatic recorders, there are two types of developer to be used: a two component developer containing toner particles and carrier beads and a single component developer containing toner particles but no carrier beads. The usage of a two component developer allows to obtain a developed image excellent in quality relatively stably; however, there are such disadvantages as difficulty in maintenance and compactization since the carrier beads are repetitively used so that they tend to deteriorate in performance, and, moreover, the mixture ratio between the toner particles and the carrier beads must be maintained at constant at all times, otherwise, the density of the resulting developed image would fluctuate.

In the case of the single component developer, there are no such disadvantages which are normally encountered when use is made of the two component developer as described above. However, when the single component developer is to be used, it is required that the single component developer be stably formed into a thin film uniform in thickness in order to have the toner particles charged sufficiently as well as uniformly. For this reason, it has been proposed to use a doctor blade as pressed against a developing sleeve. With this structure, since the developing sleeve is driven to rotate in a predetermined direction, the toner particles are partly pinched between the outer peripheral surface of the developing sleeve and the doctor blade so that the toner particles are thereby charged and formed into a thin film. In this case, however, since the doctor blade is kept pressed against the developing sleeve at a relatively strong force, that portion of the doctor blade which is in scrubbing contact with the outer peripheral surface of the sleeve gradually wears out so that the performance of the doctor blade necessarily deteriorates. If this happens, the resulting film of toner particles becomes irregular in thickness and thus in the amount of charge, which then causes a deterioration in the developing performance.

Moreover, the toner particles of the prior art single component developer were magnetically attracted to the outer peripheral surface of the developing sleeve. Thus, the toner particles of the prior art single component developer were required to contain magnetic powder and the developing device using such a prior art single component developer were required to include magnets as disposed inside of the developing sleeve so as to have the magnetic toner particles magnetically attracted to the outer peripheral surface of the developing sleeve. Such requirements necessarily would make the developing device larger in size and complicated in structure. In addition, the selection of materials for the toner particles were necessarily limited.

SUMMARY OF THE INVENTION

In accordance with one aspect of the present invention, there is provided a device for developing an electrostatic latent image by using a single component developer containing toner particles but no carrier beads. In the preferred embodiment, the toner particles of the single component developer used are not required to have magnetic material because it is so structured that the toner particles of a single component developer are electrically attracted to toner transporting means which moves past a developing station where the electrostatic latent image carried on an image bearing member is developed. For this purpose, supplying means for supplying the toner particles to be electrically attracted to the developing sleeve, preferably a sponge roller, is provided in pressure and scrubbing contact with the developing sleeve. In one example, the sponge roller is driven to rotate same in direction as the developing sleeve so that the toner particles are electrically charged due to friction and attracted to the outer peripheral surface of the developing sleeve electrostatically. In another example, the sponge roller is driven to rotate opposite in direction to the developing sleeve such that that portion of the sponge roller in contact with the developing sleeve moves in the same direction, but, in this case, the rotational speed of the sponge roller is so set that a scrubbing action takes place at the contact point between the sponge roller and the developing roller so as to be capable of charging the toner due to friction. In this manner, in accordance with this aspect of the present invention, since the toner particles are electrically attracted to the outer peripheral surface of the developing sleeve, they are not required to contain any magnetic material.

In accordance with another aspect of the present invention, there is provided a developing device having a doctor blade for forming a thin film of electrically charged toner particles on the outer peripheral surface of the developing sleeve. Such a doctor blade can be used not only with the toner particles having magnetic particles but also with the toner particles having no magnetic particles. In one embodiment, the blade is preferably disposed in a counter arrangement, i.e., extending opposite to the direction of rotation at the contact between the blade and the sleeve. And, the blade is preferably so disposed to gradually separating away from the peripheral surface of the developing sleeve in a particular manner.

In accordance with a further aspect of the present invention, there is provided a developing device including a developing sleeve which is driven to rotate in a predetermined direction, a toner supply roller which is driven to rotate same in direction as the developing sleeve in scrubbing contact therewith, and a blade assembly which includes a movable blade, holding means for holding the blade movably in a predetermined direction and biasing means for biasing the movable blade against the developing sleeve. With this structure, the movable blade is always pressed against the developing sleeve at a predetermined pressing force level, which allows to form a thin film of charged toner particles on the developing sleeve uniformly at all times.

In accordance with a still further aspect of the present invention, there is provided a developing device including a flexible developing sleeve, a toner supply roller, and a doctor blade. The toner roller is in scrubbing contact with the developing sleeve so as to supply toner particles electrostatically attracted to the developing sleeve, and when these attracted particles move past the pressure contact between the developing sleeve and the doctor blade, there is formed a thin film of charged toner particles on the developing sleeve ready to be presented for use in developing an electrostatic latent image. Since the developing sleeve is flexible or partly elastically deformable, it can be used for developing an electrostatic latent image formed on a photosensitive drum which has a relatively hard peripheral surface.

In accordance with a still further aspect of the present invention, there is provided a developing device including a developing sleeve, a toner supply roller, a doctor blade, and oscillation application means for applying oscillation to the developing sleeve. In this case, it is preferable to provide a gap between the developing sleeve and an imaging surface on which an electrostatic latent image to be developed is formed so that development takes place for the toner particles to selectively fly from the developing sleeve to the latent image on the imaging surface.

In accordance with a still further aspect of the present invention, there is provided a developing device including a developing sleeve, a toner supply roller and a doctor blade which comprises a copolymer of ethylene and tetrafluoroethylene. The doctor blade having such a composition is excellent in preventing toner sticking, and high in wear-resistance as well as triboelectric charging of toner particles.

It is therefore a primary object of the present invention to obviate the disadvantages of the prior art as described above and to provide an improved device for developing an electrostatic latent image.

Another object of the present invention is to provide an improved developing device using a single component developer, capable of forming a thin film of electrically charged toner particles to be used for developing an electrostatic latent image stably for a prolonged period of time.

A further object of the present invention is to provide a developing device high in developing performance and small in overall size.

A still further object of the present invention is to provide a developing device capable of using single component developer comprised of toner particles having no magnetic particle.

Other objects, advantages and novel features of the present invention will become apparent from the following detailed description of the invention when considered in conjunction with the accompanying drawings.

DESCRIPTION OF THE PREFERRED EMBODIMENTS

Figure 1:
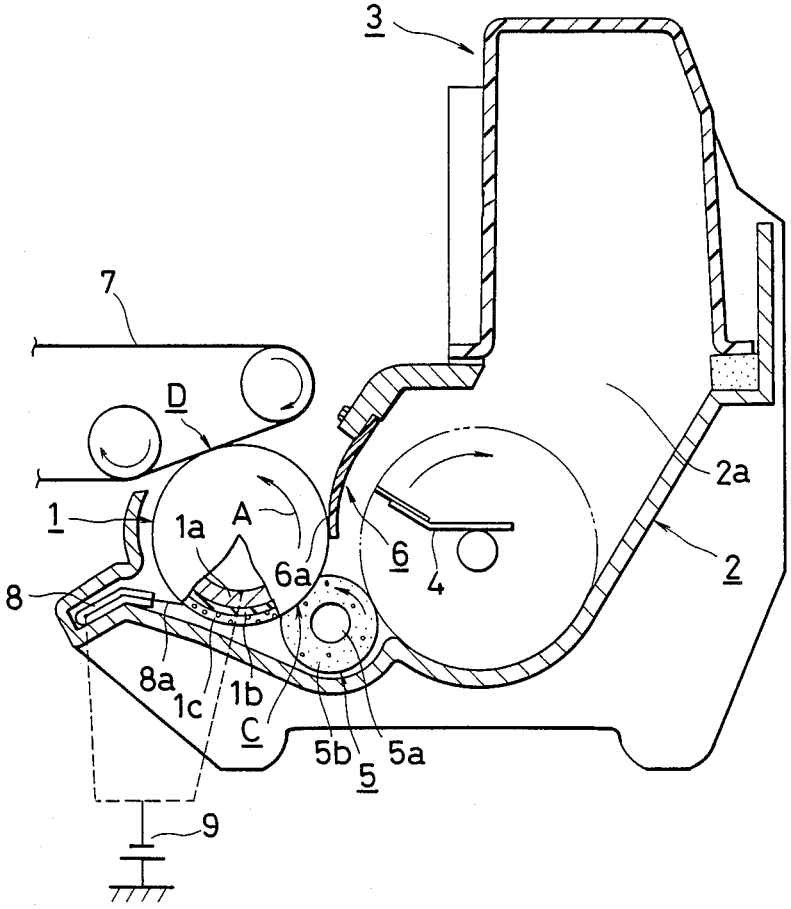
FIG. 1 is a schematic illustration showing a developing device having a doctor blade disposed in a particular orientation with respect to a developing sleeve constructed in accordance with one embodiment of the present invention.

Referring now to FIG. 1, there is schematically shown a developing device for developing an electrostatic latent image with a single component developer containing toner particles but no carrier beads. It is to be noted that, although the illustrated developing device may be used with a single component developer containing toner particles including magnetic material, it is so structured that use may be preferably made of a single component developer containing toner particles having no magnetic material.

Figure 2:
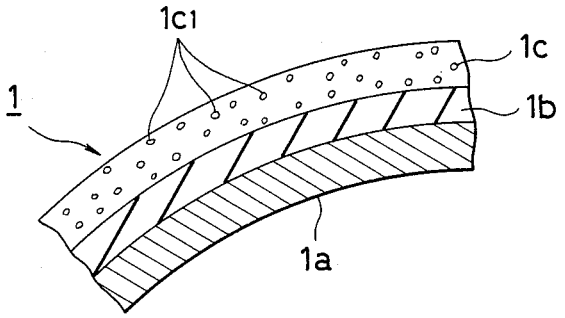
FIG. 2 is a schematic, cross-sectional view showing the internal structure of the developing sleeve 1 used in the developing device shown in FIG. 1.

As shown, the developing device includes a developing sleeve 1 as developer transporting means, which is rotatably supported and driven to rotate at constant speed in the direction indicated by the arrow A. As shown in FIG. 2, the developing sleeve 1 is preferably comprised of a tubular-shaped electrically conductive substrate 1*a* of aluminum or the like, an insulating layer 1*b* of chloroprene or the like formed on the outer surface of the substrate 1*a* and an electrode layer 1*c* including a number of electrode particles $1c_1$ dispersed in a matrix material as electrically isolated one from another. In this case, for example, by having electrically conductive powder, such as carbon black, mixed in an electrically insulating material, such as an epoxy resin, as uniformly dispersed therein, and then spreading this mixture material on the insulating layer 1b, the electrode layer 1c having a number of minute electrodes uniformly dispersed therein can be formed with ease. Use may be preferably made of metal powder, such as copper powder, as the material for the minute electrodes. In addition, as the dispersion matrix material for having the minute electrodes dispersed as electrically isolated one from another, selection may be made from a broad variety of materials and use may be preferably made of such materials as acrylic resin, urethane, styrene, acrylic-urethane, epoxy-silicon and epoxy-teflon. It is to be noted, however, that the selection of material should be made such that the matrix material and the toner material are far apart in the triboelectric series as much as possible so as to allow the toner particles to be electrically charged efficiently.

With the use of the developing sleeve 1 having the electrode layer 1c having a uniform dispersion of minute electrode particles as its outermost layer as described above, even if use is made of a single component developer having toner particles but no carrier beads, the image density is positively increased for a line image due to the so-called edge effect, which allows to obtain an ideal developing performance. In addition, in the case where use is made of an insulating material, such as epoxy resin, having dispersed therein low electrical resistance powder, such as carbon black, as the fine electrodes $1c_1$, since the level of attraction is higher between an insulating material and the toner particles than between a metal and the toner particles, a developer having no magnetic material, such as a non-magnetic, single component developer can be carried on the electrode layer 1c as attracted thereto. In this case, the toner particles are temporarily attracted to the electrode layer 1c of the developing sleeve 1 not magnetically but electrostatically with the aid of Van der Waals forces. As will be made clear later, the electrically conductive substrate 1a is connected to a bias source 9 so as to be maintained at a predetermined potential which is the same as that of a charge removing brush 8. It is to be noted that the insulating layer 1b is provided so as to maintain an electric field strength suitable for development, but this may be discarded, if desired.

To the right of the developing sleeve 1 is provided a hopper 2 for storing therein a quantity of single component developer. In the illustrated embodiment, the single component developer used is a non-magnetic, single component developer having no magnetic material. The hopper 2 is provided with a supply port 2a at its top, where a cartridge 3 filled with a supply of the toner may be detachably attached. When the cartridge 3 is opened after attachment, the toner drops by its own weight into the hopper 2. An agitator 4 is provided inside of the hopper 2 and it is driven to rotate in the direction indicated by the arrow so as to prevent the toner from becoming agglomerated and to move the toner inside of the hopper 2 generally toward the developing sleeve 1.

At an outlet port of the hopper 2 for supplying the toner to the developing sleeve 1 and as interposed between the developing sleeve 1 and the agitator 4 is disposed a toner supply roller 5 which serves to promote the movement of the toner onto the outer peripheral surface of the developing sleeve 1. The toner supply roller 5 is rotatably supported at a position such that its outer peripheral surface is pressed against and in scrubbing contact with the peripheral surface of the developing sleeve 1, and, in the preferred embodiment, the toner supply roller 5 is driven to rotate at constant speed in the counterclockwise direction, or the same direction as that of the developing sleeve 1. Since the toner supply roller 5 and the developing sleeve 1 are driven to rotate in the same direction, those portions of the toner supply roller 5 and the developing sleeve 1 which are in contact under pressure at a contact region C move in opposite directions scrubbingly. With this, the toner particles sandwiched between the toner supply roller 5 and the developing sleeve 1 are subjected to frictional charging and thus the toner particles are efficiently charged. At the same time, a film of charged toner particles is formed on the the developing sleeve 1.

The preferable peripheral speed of the toner supply roller 5 differs depending on the peripheral speed of the developing sleeve 1, and, in general, it is preferable that the peripheral speed of the toner supply roller 5 be set higher than that of the developing sleeve 1; however, if it is set too high, it would cause toner scattering, toner sticking and/or agglomeration of toner particles, it should be set within a suitable range. It should also be noted that the material at the outer surface of the toner supply roller 5 and the toner material are separated far apart in the triboelectric series in order to charge the toner particles efficiently.

In the illustrated embodiment, as the toner supply roller 5, there is provided a sponge roller 5 including a shaft 5a and a surface layer 5b formed on the shaft 5a from an elastic material, such as polyurethane foam rubber, having the porosity of 10 to 100 in terms of the number of cells. The sponge roller 5 is driven to rotate same in direction as the developing sleeve 1 as being in pressure contact therewith. In the present embodiment, the developing sleeve 1 has a diameter of 25.4 mm and driven to rotate at 400 rpm, and the sponge roller 5 of 14 mm in diameter is driven to rotate at 800 rpm, so that the ratio in peripheral speed between the developing sleeve 1 and the sponge roller 5 is set approximately at 10:11. It is to be noted that in order to form a toner layer of appropriate thickness on the developing sleeve 1 with an appropriate supply of the toner particles to the contact region C, it is better that the hardness of the fexible material forming the surface layer 5b is higher and the size of pores is smaller.

As described above, with the provision of the toner supply roller 5, the toner particles freshly replenished into the hopper 2 are mixed with the existing toner particles through the rotating action of the agitator 4 and then supplied smoothly to the contact region C following the rotational motion of the toner supply roller 5. At the contact region C, the toner particles thus supplied come to be sandwiched between the developing sleeve 1 and the toner supply roller 5 so that the toner particles become charged through frictional charging due to scrubbing action between the developing sleeve 1 and the toner supply roller 5 so that the toner particles thus charged become attracted to the peripheral surface of the developing sleeve 1. In this case, the toner particles are also charged and electrically attracted to the toner supply roller 5 through frictional charging between the toner supply roller 5 and the toner particles. Thus, even if the single component developer used is comprised of toner particles having no magnetic material, i.e., non-magnetic, single component toner, it can be effectively transported from the hopper 2 to the developing sleeve 1 smoothly.

Figure 3:
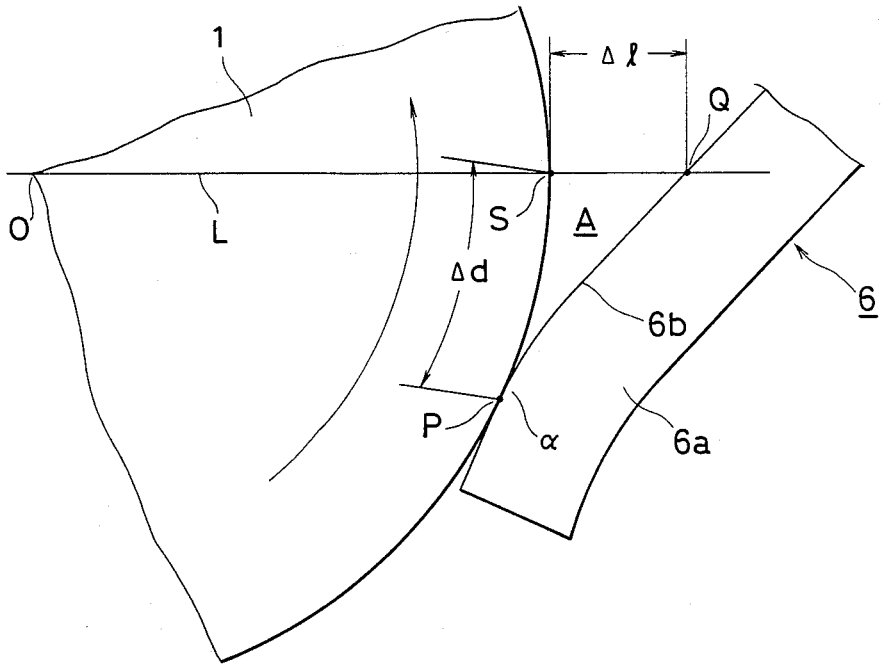
FIG. 3 is a schematic illustration showing on a somewhat enlarged scale the positional relation between the developing sleeve 1 and the doctor blade 6 provided in the device shown in FIG. 1.

Downstream of the toner supply roller 5 with respect to the direction of rotation of the developing roller 1 is disposed a doctor blade 6 which is pressed against the peripheral surface of the developing sleeve 1 so as to form a thin film of toner particles, charged to a predetermined polarity and having a predetermined thickness. As will be described in detail below, the doctor blade 6 is disposed in a particular fashion with respect to the developing sleeve 1 in accordance with one aspect of the present invention. The doctor blade has its proximal end fixedly attached to the housing of the developing device and, as shown in FIG. 3, has its distal end 6*a* pressed uniformly against the peripheral surface of the developing sleeve 1 across its entire width, and, thus, as the doctor blade 6 serves to regulate the thickness of the toner particles transported as carried on the peripheral surface of the developing sleeve 1 as the developing sleeve 1 rotates so that there is formed a thin film of charged toner particles having a desired thickness. In this case, in order to prevent the toner particles from accumulating at the downstream side of a contact point P between the developing sleeve 1 and the blade 6 with respect to the direction of transportation of the toner particles, a downstream space A between the peripheral surface of the developing sleeve 1 and the blade 6 is defined such that the blade 6 is separated further away from the peripheral surface of the developing sleeve 1 in a particular manner along the peripheral surface of the developing sleeve 1 from the contact point P in the downstream direction.

Described more in detail, as shown in FIG. 3, an imaginary reference point is set at point S which is separated away from the contact point P over a distance delta d along the peripheral surface of the developing sleeve 1 in the downstream direction, and an imaginary radial straight line L is drawn from the center 0 of the developing sleeve 1 past the reference point S. In the illustrated embodiment, the distance delta d is set at 1 mm. And, the extension of the radial line L intersects the downstream surface 6*b* of the blade 6, which is set as point Q. And, the magnitude of this separating distance delta l between the points S and Q is set at a particular value to define the generally wedge-shaped space A in a particular shape. It has been found experimentally that, in the case of using non-magnetic, single component toner, the separating distance delta l ranges between 0.3 and 1.5 mm for the developing sleeve 1 having the radius of curvature, or radius in the illustrated embodiment, of 3 mm or larger. Under the condition, in the illustrated embodiment, the doctor blade 6 is so oriented that the separating distance delta l is equal to 0.3 mm.

The doctor blade 6 is preferably comprised of a material excellent in parting characteristic with the toner used, and the preferred material includes a fluorine-containing material, such as tetrafluoroethylene-perfluoroalkylvinylether copolymer (PFA). Thus, the toner is well prevented from being stuck to the doctor blade 6, thereby permitting to form a thin film of charged toner particles having a predetermined thickness stably as well as uniformly at all times. In addition, as will be described in detail later, in the illustrated embodiment, since an organic photosensitive belt is used as an imaging member for forming thereon an electrostatic latent image of the negative polarity, it is required to charge the toner to the positive polarity. As the fluorine-containing resin has a characteristic to triboelectrically charge the toner to the positive polarity, the present embodiment allows to carry out the required charging of the toner at high efficiency. With this structure, the toner can be sufficiently charged to a desired polarity and regulated into a desired thickness without causing toner sticking on the downstream surface 6*b* of the doctor blade 6. It is to be noted that the doctor blade 6 is not necessarily comprised of a material having a desired parting characteristic with the toner, and it is only required that at least that portion of the doctor blade which is brought into contact with the developing sleeve 1 as indicated by alpha in FIG. 3 is comprised of such a material excellent in the parting characteristic with the toner.

At an appropriate position downstream of the doctor blade 6 with respect to the rotary transportation path defined by the peripheral surface of the developing sleeve 1 is defined a developing station D where the peripheral surface of the developing sleeve 1 is in rolling contact with an organic photoconductive belt (OPC belt) 7 in an endless shape, which serves as an image bearing member for bearing thereon an image. Thus, the OPC belt 7 is subjected to uniform charging and image exposure at appropriate locations, which are not shown, and thus an electrostatic latent image is formed on the belt 8 by the negative charge and moves past the developing station D. On the other hand, as the developing sleeve 1 rotates in the direction indicated by the arrow A, a thin film of positively charged toner particles formed on the developing sleeve 1 by the blade 6 also moves past the developing station D. In this case, since the electrode layer 1*c* at the surface of the developing sleeve 1 is formed from an electrically insulating material, such as an epoxy resin, to which the toner particles may be easily adhered, even if the toner particles are non-magnetic, they can be carried on the entire outer peripheral surface of the sleeve 1. Thus, the electrostatic latent image of negative polarity on the belt 7 can be developed by the thin film of positively charged toner particles advantageously at the developing station D.

Downstream of the developing station D with respect to the direction of rotation of the developing sleeve 1 is disposed a charge removing brush 8 for removing any undesired charge accumulated on the peripheral surface of the developing sleeve 1. After development, the developing sleeve 1 may retain undesired charge on its outer peripheral surface, which could cause a deterioration in the next cycle of development, and, thus, it is preferable to remove such undesired charge from the developing sleeve after development. In particular, the charge accumulated on the insulating material, such as an epoxy resin, forming the electrode layer 1*c* of the developing sleeve 1 is difficult to be removed as compared with a metal or the like, and, thus, it is required to provide a charge-removing element which can eliminate any undesired charge efficiently. In the illustrated embodiment, the charge-removing brush 8 includes electrically conductive fibers 8*a* and it is so disposed that the fibers 8*a* have their tip ends located in sliding contact with the peripheral surface of the sleeve 1 as extending in the trailing direction under an appropriate pressure by their own elasticity. The mounting position, material and size of the fibers 8*a* are suitably determined so as to allow to obtain such an arrangement. With this, the brush fibers 8*a* are uniformly set in contact with the peripheral surface of the sleeve 1 across the entire width thereof so that the undesired charge can be completely removed from the peripheral surface of the sleeve 1 as it rotates. It is to be also noted that the charge-removing brush 8 is connected to a bias supply source 9 which is also connected to the electrically conductive base 1*a* of the sleeve 1. Thus, the undesired charge accumulated on the peripheral surface of the developing sleeve 1 can be removed efficiently as well as selectively.

As the developing sleeve 1 further rotates, the residual toner particles remaining on the peripheral surface of the developing sleeve 1, whose electrostatic attractive force has been weakened by the brush 8, comes to be transported to the position where the toner supply roll 5 is disposed, where the residual charge on the sleeve 1 is separated away from the sleeve 1 and mixed with the toner particles supplied by the agitator 4. In the present embodiment, since the toner supply roll 5 made of a sponge roll is provided to rotate in pressure and scrubbing contact with the developing sleeve 1, the residual toner particles transported as carried on the developing sleeve 1 are efficiently separated away from the developing sleeve 1. That is, the sponge roll 5 becomes partly deformed as pressed against the developing sleeve 1 thereby forming a contact surface condition between the developing sleeve 1 and the sponge roll 5 at the contact region C, and at the upstream side of the contact region C with respect to the direction of rotation of the sponge roll 5, the toner particles transported as carried on the sponge roll 5 are applied to the peripheral surface of the developing sleeve 1; whereas, at the downstream side of the contact region C with respect to the direction of rotation of the sponge roll 5, the sponge roll 5 functions to remove the residual toner particles on the developing sleeve 1 as separated therefrom. The toner particles separated away from the developing sleeve 1 by the sponge roll 5 are returned toward the hopper 2 where they are mixed with the other toner particles before being presented for use again.

It is to be noted that, as pointed out earlier, use has been made of a non-magnetic, single component developer in the above-described embodiment, the present invention may also be applied to a developing system which uses a magnetic, single component developer or a conventional two component developer using magnetic carrier beads, if desired. In such a case, since one or more magnets are disposed so as to have the magnetic toner particles or carrier beads to be in contact with the peripheral surface of the developing sleeve 1, the toner supply roll 5 may be discarded, if desired. It should also be noted that the present invention is also applicable to the case where use is made of a photosensitive drum instead of the endless photosensitive belt 7 as an image bearing member.

In accordance with another aspect of the present invention, there is provided a developing device including a blade assembly having a movable blade and biasing means for biasing the movable blade to be pressed against a developing sleeve. Such a structure is advantageous in maintaining a predetermined contact pressure between the blade and the developing sleeve so that there is obtained a thin film of charged toner particles having a predetermined thickness for an extended period of time. This aspect of the present invention will now be described with reference to FIG. 4. It is to be noted that those elements which are identical to those in FIG. 1 are indicated by like numerals.

Figure 4:
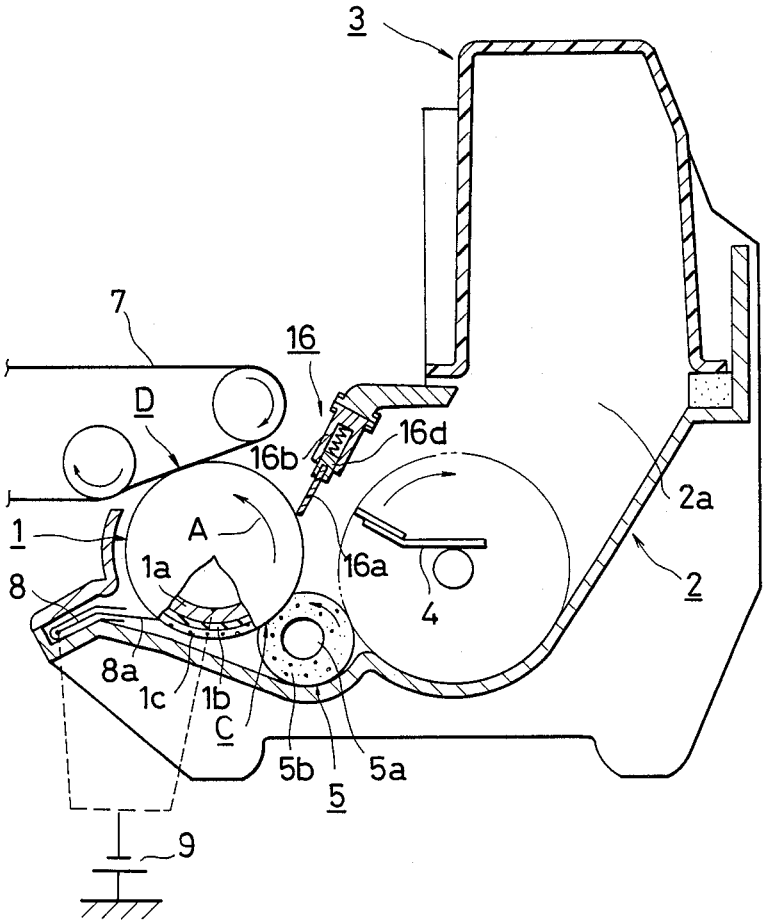
FIG. 4. is a schematic illustration showing a developing device which includes a blade assembly having a movable blade constructed in accordance with another embodiment of the present invention.

As shown in FIG. 4, the developing device constructed in accordance with this aspect of the present invention also includes the developing sleeve 1 and the sponge roller 5, so that the toner particles 2*a* stored in the hopper 2 are first mixed and transported by the agitator 4, and, then, supplied to the developing sleeve 1 by the sponge roller 5. As described previously, the toner particles 2*a* are charged and electrostatically attracted to the peripheral surface of the developing sleeve 1, so that there is formed a film of charged toner particles on the sleeve 1. A doctor blade assembly 16 including a movable blade 16*a*, a support member 16*b* for supporting and guiding the movement of the movable blade 16*a*, and a spring 16*d* is disposed downstream of the sponge roller 5 with respect to the transporting direction of the toner particles carried on the developing sleeve 1. Thus, as the developing sleeve 1 rotates counterclockwise, the toner particles carried on the peripheral surface of the developing sleeve 1 as electrostatically attracted thereto are forced to move past the contact point between the developing sleeve 1 and the doctor blade 16*a*, whereby the toner particles carried on the developing sleeve 1 are regulated in thickness and properly charged.

Figure 5:
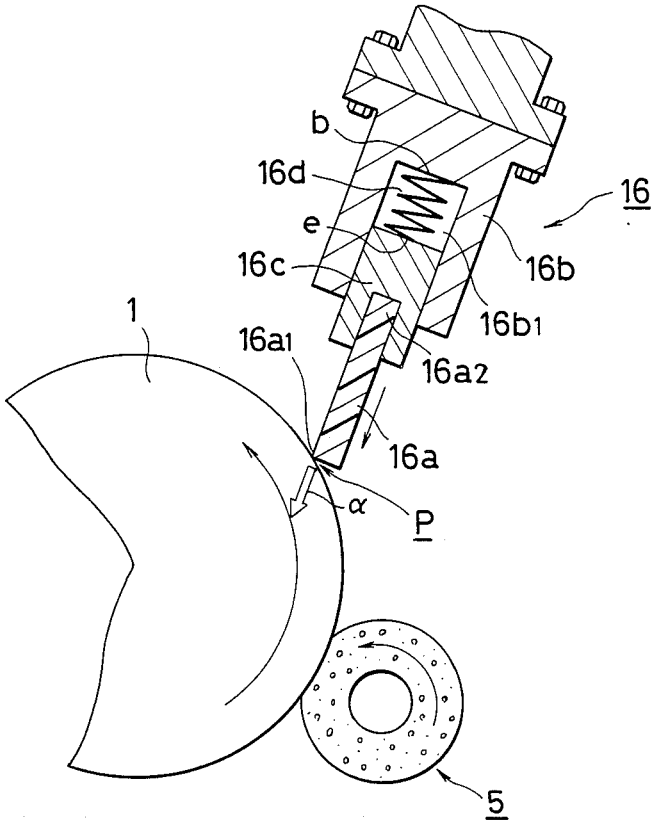
FIG. 5 is a schematic illustration showing on a somewhat enlarged scale the blade assembly provided in the device shown in FIG. 4.

The doctor blade assembly 16 is illustrated in more in detail in FIG. 5. As shown, the doctor blade assembly 16 includes a movable blade 16*a* which has its forward edge $16a_1$ pressed against the peripheral surface of the developing sleeve 1. In the illustrated embodiment, the blade assembly 16 also includes a holding member 16 for holding the movable blade 16*a* so as to be movable in a direction indicated by alpha, or generally counter to the direction of rotation of the developing sleeve 1 at the contact point. More specifically, the movable blade 16*a* has its proximal end $16a_2$ fixedly fitted into a sliding member 16*c*, which, in turn, is slidingly fitted into a guide recess $16b_1$ formed in the holding member 16*b* which is fixedly attached to the housing of the device. A compression spring 16*d* is inserted in the guide recess $16b_1$ interposed between a bottom surface b of the guide recess $16b_1$ and an end surface e of the sliding member 16*c* so that the spring 16*d* always serves to push the movable blade 16*a* in the direction indicated by alpha. As a result, the contact edge $16a_1$ of the movable blade 16*a* is always pressed against the developing sleeve 1 uniformly across its full width since the movable blade 16*a* is biased by the spring 16*d*. Thus, even if the contact edge $16a_1$ wears after having been used for a long period of time, since the required contact pressure is maintained by the recovery force of the spring 16*d*, the functions of triboelectric charging and film thickness regulation are maintained at high level.

In the preferred embodiment, at least a contact portion P of the movable blade 16*a* which comes into contact with the developing sleeve 1 and its neighborhood is comprised of a material excellent in the parting or separating characteristic with the toner used. When so structured, the toner is prevented from being stuck to the movable blade 16*a*, thereby ensuring the blade 16*a* to carry out the required charging and film thickness regulating functions to carry out for a long period of time. Similarly with the previous embodiment, in the case where an electrostatic latent image of the negative polarity is to be formed on the OPC belt 7, since the toner is required to be charged to the positive polarity, it is preferable to form the blade 16*a* from a fluorine-containing resin, such as tetrafluoroethylene-perfluoroalkylvinylether copolymer (PFA), at least partly at its forward end portion because such a resin charges the toner to the positive polarity without causing toner sticking. It is true that a material excellent in the parting characteristic tends to be inferior in the wear-resistance characteristic; however, in accordance with this aspect of the present invention, since the movable blade 16a is so provided to be always pressed against the developing sleeve 1 under a preset biasing force, any deterioration in the film thickness regulating function due to wear is suitably avoided.

Figure 6:
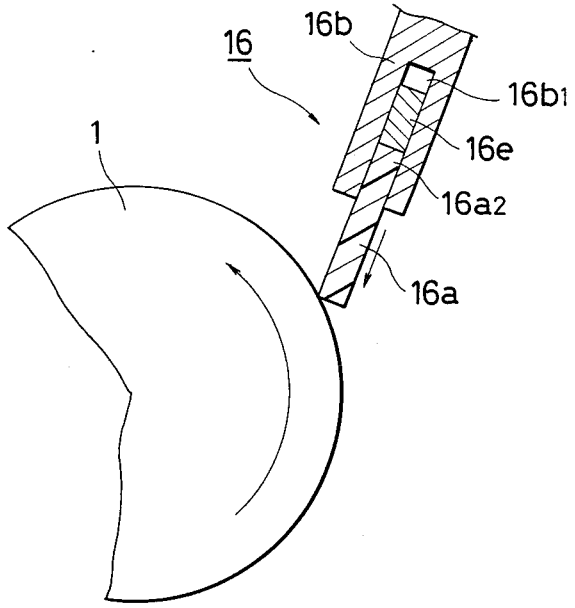
FIGS. 6 and 7 are schematic illustrations showing modifications of the blade assembly shown in FIG. 5.
Figure 7:
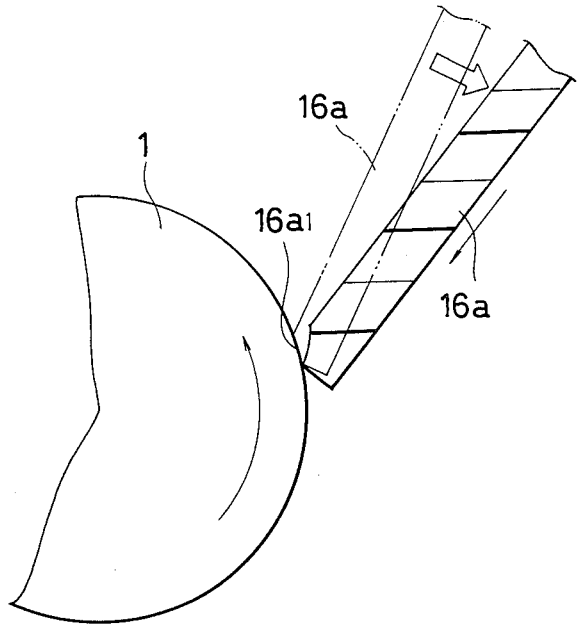

FIG. 6 shows a modification of the blade assembly described above. That is, in this embodiment, use is made of a weight 16e in place of the spring 16d for imparting a required biasing force to the movable blade 16a. Alternatively, the guide recess $16b_1$ may be defined in the form of an air cylinder structure, and air under pressure may be supplied to the guide recess $16b_1$ so as to apply the required biasing force to the movable blade 16a. FIG. 7 shows a further modification, in which the blade 16a is provided to be shiftable in orientation with respect to the developing sleeve 1 so that when wear occurs at the contact edge $16a_1$, the blade 16a is reoriented as indicated by the white arrow, whereby the the contact area between the developing sleeve 1 and the blade 16a may be maintained at constant. In this case also, the movable blade 16a is biased toward the developing sleeve 1 by any of the embodiments described above.

A further aspect of the present invention will now be described with particular reference to FIG. 8. As shown, the developing device constructed in accordance with this aspect of the present invention is also similar in many respects to the previously described embodiments shown in FIGS. 1 and 4 so that like elements are indicated by like numerals in FIG. 8. Similarly, the present developing device also includes the developing sleeve 1 and the toner supply roller or sponge roller 5. It is to be noted, however, that in accordance with this aspect of the present invention, the developing sleeve 1 and the toner supply roller 5 are driven to rotate in opposite directions so that that portion of the developing sleeve 1 which is in pressure contact with the toner supply roller 5 move in the same direction at the contact point. In this case, however, the peripheral speeds of the respective developing sleeve 1 and toner supply roller 5 are set to be different so that there is obtained a scrubbing action at the contact point between the developing sleeve 1 and the toner supply roller 5, and, thus, the toner particles can be scrubbed and triboelectrically charged suitably. The ratio between the peripheral speed of the developing sleeve 1 to the peripheral speed of the toner supply roller 5 is preferably set in a range between 4:3 and 4:1, and most preferably between 3:2 and 3:1. Such a structure is particularly advantageous because the rotational speed of the developing sleeve 1 can be set at a relatively high level, which, in turn, allows to move the belt 7 at high speed, thereby increasing the operational speed of the entire imaging system. Furthermore, since the torque requirements for driving to rotate the developing sleeve 1 and the toner supply roller 5 can be relaxed in the present structure, the power consumption is decreased and a small capacity driving motor can be used.

It is to be noted that the toner supply roller 5 may be formed in the shape of an endless belt other than the roller shown in the previous embodiments. Moreover, if desired, the surface layer 5b of the toner supply roller 5 may be formed from various materials, such as rubber, plastic materials, and metals, other than sponge.

Figure 8:
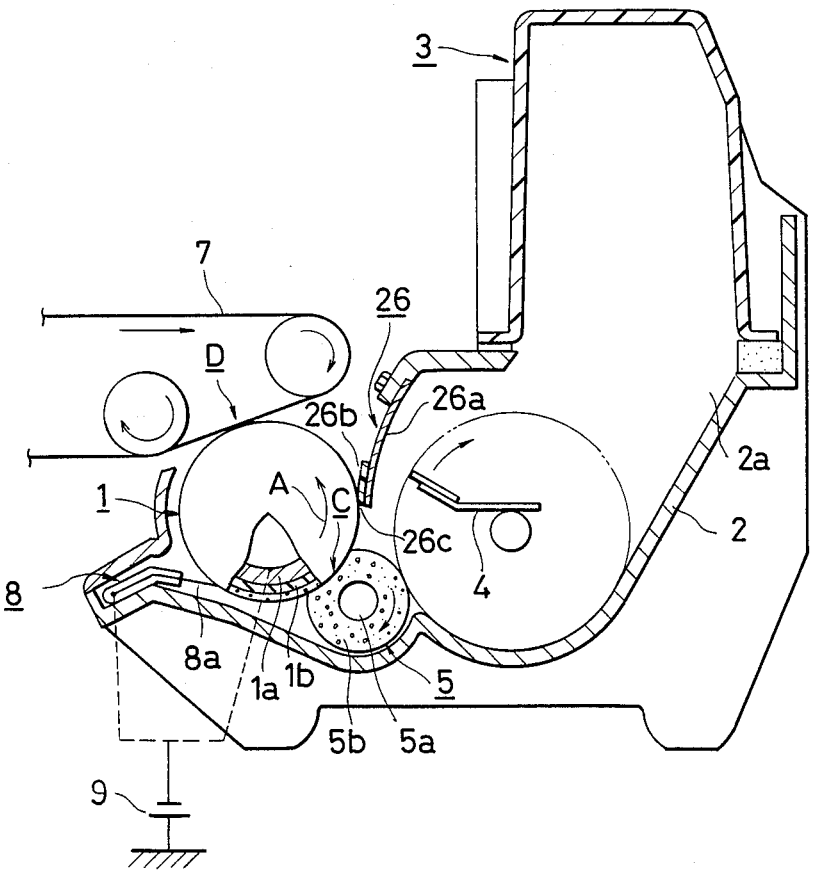
FIG. 8 is a schematic illustration showing a developing device, in which the developing sleeve and the toner supply roller are driven to rotate in the opposite directions, constructed in accordance with a further embodiment of the present invention.

As shown in FIG. 8, the present developing device also includes a doctor blade 26 pressed against the developing sleeve downstream of the toner supply roller 5. In the illustrated embodiment, the doctor blade 26 includes a support plate 26a of an elastic material and a contact member 26b which is fixedly attached to one surface of the support plate 26a so as to be in pressure contact with the developing sleeve 1. The contact member 26b is preferably comprised of a fluorine-containing material excellent in the parting characteristic with the toner used, such as tetrafluoroethylene-perfluoroalikylvinylether copolymer (PFA), and, in particular, the contact member 26c has a bottom edge 26c which is pressed against the peripheral surface of the developing sleeve 1 across its full width uniformly. With such a structure, the toner is prevented form being stuck to the blade 26 so that a film of charged toner particles having a predetermined thickness can be formed for a long period of time. Other than PFA, the contact member 26b may be comprised of a fluorine-containing material, such as polytetrafluoroethylene (PTFE), tetrafluoroethylene-hexafluoroproplylene copolymer (FEP), tetrafluoroetyylene-ethylene copolymer (ETFE), polychlorotrifluoroethylene (PCTFE), and, furthermore, a material excellent in the parting characteristic with the toner used, such as polyethylene, polypropylene, or silicone resin. In addition, in order to provide an enhanced wear-resistance characteristic, an additive, such as carbon black, carbon fiber, glass fiber, silica fine powder, or SiC fine powder, can be added to any of these materials, if desired.

It is to be noted that, in any of the embodiments described above, the toner particles are first electrically charged between the developing sleeve 1 and the toner supply roller 5 and electrostatically attracted to the developing sleeve 1 thereby forming a film of charged toner particles, and, then, the film of charged toner particles is again moved past the pressure contact between the developing sleeve 1 and the doctor blade 26 to form a thin film of charged toner particles having a predetermined thickness. However, if the conditions are so set that a film of charged toner particles formed on the developing sleeve 1 by the toner supply roller 5 has a sufficient charge level and a desired thickness, then the doctor blade can be discarded, if necessary. It should also be noted that use has been made of non-magnetic, single component toner, but magnetic toner can also be used in the present invention. Besides, the doctor blade can be formed from a magnetic material at least partly with one or more of magnets disposed inside of the developing sleeve, whereby the doctor blade is pressed against the developing sleeve as magnetically attracted thereto. In this case, it is preferable to support the blade pivotally.

Figure 9:
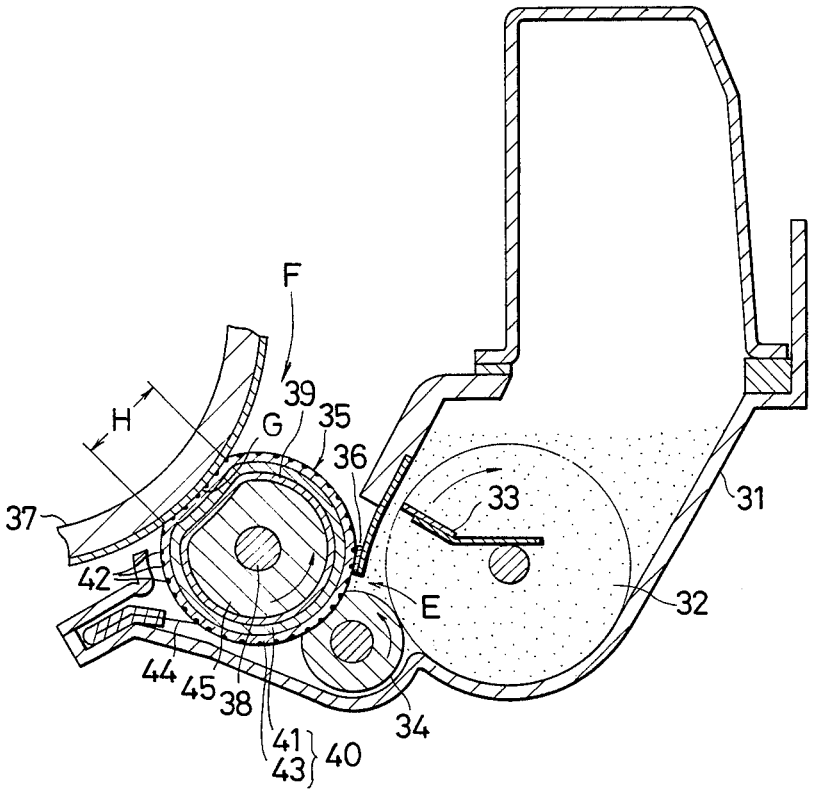
FIG. 9 is a schematic illustration showing a developing device constructed in accordance with a still further embodiment of the present invention and including a flexible developing sleeve.

A still further aspect of the present invention will be described with particular reference to FIG. 9. This aspect of the present invention is directed to provide a developing device including a an elastically deformable developing roller, thereby allowing to use the developing roller in contact with a hard-surfaced imaging member, such as photosensitive drum. As shown in FIG. 9, the present developing device includes a tank or hopper 31 for storing therein a quantity of developer or toner particles 32, which may be non-magnetic or magnetic. The toner particles 32 inside of the hopper 31 are stirred by an agitator 33 thereby gradually moving the toner particles 32 toward a toner supply roller 34, and, thus, the toner particles are then supplied to a developing roller 35, which is driven to rotate counterclockwise, as indicated by the arrow E. Since the toner supply roller 34 is in scrubbing contact with the developing roller 35, the toner particles 32 are electrically charged and thus electrostatically attracted to the developing roller 35. The toner particles 32 are then transported along a circular path defined by the circumference of the developing sleeve 35 during which the toner particles 32 are moved past a pressure contact point between the developing sleeve 1 and a doctor blade 36, whereby a thin film of charged toner particles having a predetermined thickness is formed on the developing roller 35. The present developing device is applied to develop an electrostatic latent image formed on a photosensitive drum 37, which is driven to rotate in the direction indicated by the arrow F, so that a developing region G is defined at the contact therebetween. Thus, the thin film of charged toner particles are selectively transferred from the developing sleeve 1 to the latent image on the drum 37 at the developing region G.

As shown in FIG. 9, the developing roller 35 includes a rigid shaft 38, an elastic layer 45 formed around the shaft 38, an electrically conductive layer 39 formed on the elastic layer 45 and a surface layer 40 formed on the conductive layer 39. It is to be noted that the conductive layer 39 is opposed to the drum 37 and serves as a counter electrode with respect to an electrostatic latent image formed on the drum 37. If desired, an appropriate bias voltage is applied to the conductive layer 39. In the illustrated embodiment, the surface layer 40 includes an inner dielectric layer 41 and an electrode dispersion layer 43 having a number of fine electrodes 42 dispersed in a dielectric matrix material as dispersed therein. These fine electrodes 42 are comprised of an electrically conductive material, such as carbon or metal, and they are dispersed as electrically isolated one from another and also from the conductive layer 39, thereby serving as floating electrodes. Also provided in the device in contact with the peripheral surface of the developing roller 35 is a charge-removing brush 44 for removing residual charge on the developing roller after development, in particular the charge accumulated on the fine electrodes 42 exposed at the peripheral surface of the developing roller 35.

The elastic layer 45 may be formed to have any desired thickness to provide an elastic deformability to the developing roller 35. This elastic layer 45 is preferably comprised of a foam material, such as sponge rubber or urethane foam, or any other appropriate material which is elastic in nature. In the illustrated embodiment, the conductive layer 39 is also comprised of a material which is not only electrically conductive but also flexible or elastic in nature. The surface layer 40 also preferably comprises a dielectric, elastic material, such as urethane rubber, silicone rubber, or elastic plastic, excepting the electrodes 42. As a result, the developing roller 35 is elastically deformable substantially in its entire structure excepting the rigid shaft 38. For this reason, as clearly shown in FIG. 9, even if the developing roller 35 is pressed against the rigid photosensitive drum 37 having a relatively hard peripheral surface to carry out contact development, that portion of the developing roller 35 which is in contact with the drum 37 elastically deforms so that no undesired forces are produced between the two and there is obtained a relatively large contact area H therebetween. As a result, the developing efficiency is increased, the developing speed is increased, and the resultant image is enhanced in quality. Furthermore, even if an eccentricity is present among the various layers of the developing roller 35 due to manufacturing tolerances, since the developing roller 35 elastically deforms substantially, such an eccentricity is suitably absorbed, thereby preventing any undesired effect from being applied to the developing function.

The elastic, electrically conductive layer 39 may be formed, for example, by forming an electrically conductive rubber into a cylindrical shape; on the other hand, an electrically conductive thin film fabricated from nickel, or a metal, such as copper, in the form of a seamless cylinder by the electroforming method can also be used for the conductive layer 39 advantageously. The latter approach is less expensive. Alternatively, use may also be made of a flexible film of polyimide, polyester, or the like, having formed thereon an electrically conductive layer of aluminum, copper or the like by evaporation for the conductive layer 39. Such a film must be formed into a cylindrical shape if it is not already cylindrical.

It is to be noted that various modifications in structure from the developing roller 35 shown in FIG. 9 are possible without departing from the scope of this aspect of the present invention. For example, the surface layer 40 may be so structured without the fine electrodes 42, or the surface layer 40 may be discared, if desired, in which case the conductive layer 39 becomes exposed and provides a outermost peripheral surface for carrying thereon the toner particles 32. The dielectric layer formed at the outermost position of the developing roller 35 is preferably comprised of a material which is capable of triboelectrically charging the toner particles 32 to a desired polarity. In addition, regarding the surface layer 40 and the conductive layer 39, they can be formed to be elastically deformable not only by using an elastic material, but also by using a material which is rigid in nature in its own right. In the latter case, however, it should be made sufficiently thin so as to provide a required elastic deformability.

Figure 10:
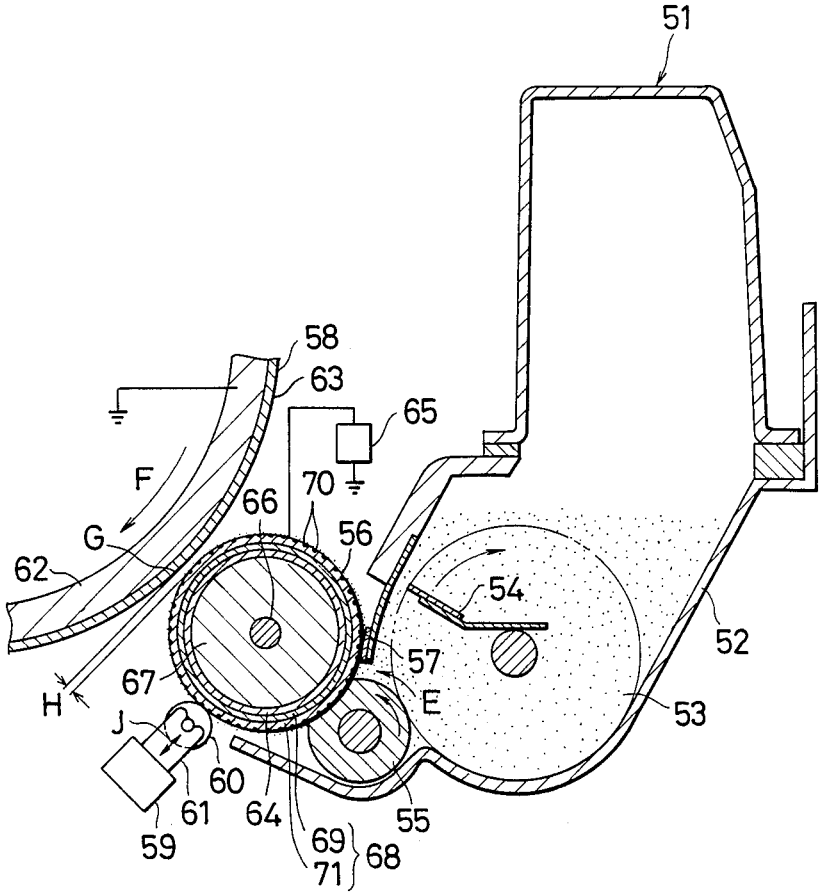
FIG. 10 is a schematic illustration showing a developing device constructed in accordance with a still further embodiment of the present invention and including a developing sleeve located spaced apart from an imaging surface on which an electrostatic latent image to be developed is formed over a predetermined gap and means for imparting oscillation to the developing sleeve.
Figure 11:
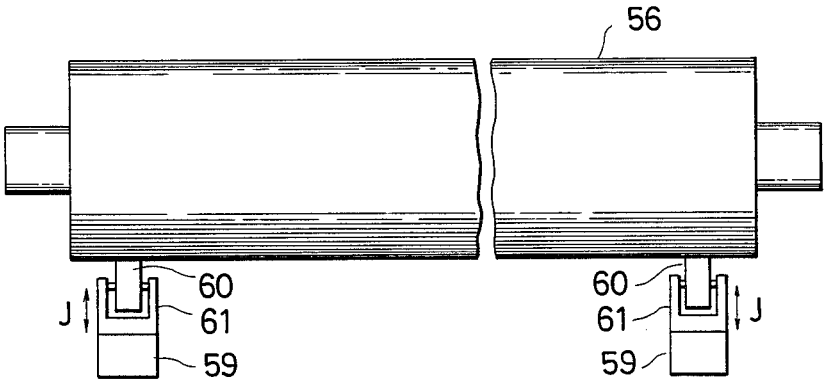
FIG. 11 is a schematic illustration showing on an enlarged scale part of the structure shown in FIG. 10.
Figure 12:
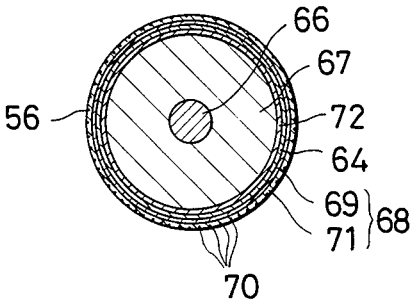
FIG. 12 is a schematic illustration showing a developing sleeve provided with a circumferential oscillating imparting means therearound and which may also be used in the developing device shown in FIG. 10.

A still further aspect of the present invention will now be described with particular reference to FIGS. 10 through 12. This aspect of the present invention is characterized in imparting oscillation to a developing roller. As shown in FIG. 10, the present developing device 51 also includes a tank or hopper 52 for storing therein a quantity of toner particles 53 or non-magnetic, single component toner particles in the illustrated embodiment. The toner particles 53 are stirred by an agitator 54, which causes the toner particles 53 to be well mixed and to be generally transported toward a toner supply roller or sponge roller 55 in the illustrated embodiment. The toner supply roller 55 is driven to rotate counterclockwise and is in scrubbing contact with a developing roller 56 which is also driven to rotate counterclockwise. Thus, the toner particles 53 are supplied to the developing roller 56 as indicated by the arrow E and electrically charged at the scrubbing contact, so that they are electrostatically attracted to the developing roller 56. The toner particles are then carried by the developing roller 56 and formed into a thin film sufficiently charged and regulated in thickness when moving past the contact between the developing roller 56 and a doctor blade 57. A further rotation of the developing roller 56 bring the thus formed thin film of charged toner particles to the developing region G where the toner particles are selectively transferred to an electrostatic latent image formed on a photosensitive drum 58. It is to be noted that, in the illustrated embodiment, a gap H is provided between the developing roller 56 and the drum 58 at the developing region G, so that the so-called non-contact development is carried out in this case, whereby the toner particles fly over the gap G to be deposited on the drum 58.

As shown in FIG. 10, also provided in the developing device 51 is an oscillation applying unit 59 for applying oscillation to the developing roller 56, which is disposed downstream of the developing region G, but upstream of the toner supply roller 55. As shown in FIG. 11, there is provided a pair of oscillating rollers 60, 60 are provided one at each end of the developing roller 56. These oscillating rollers 60, 60 are operatively coupled to respective oscillating imparting units 59, 59, through support members 61, 61 and, thus, the rollers 60, 60 are set in oscillation in the direction indicated by the arrows J, J. As a result, the developing roller 56 and thus the toner particles carried thereon are also set in oscillation. With the application of oscillation in this manner, the toner particles can be charged more efficiently and uniformly. In addition, such oscillation helps to break away those toner particles tending to stick to the developing roller 56 and/or the doctor blade 57, so that the roller 56 and the blade 57 can be maintained free of toner sticking. Moreover, the oscillation also contributes to make the resulting toner film more uniform in thickness and charger level, and the toner particles are prevented from forming clumps, which would deteriorate the quality of the resulting image.

As described previously, the developing roller 56 is spaced apart from the photosensitive drum 58 over a predetermined gap at the developing region G so that the contact development is carried out in the present embodiment by having the toner particles selectively fly over the gap. The developing roller 56 includes an electrically conductive layer 64 which also serves as an opposite electrode against an electrically conductive layer 62 of the photosensitive drum 58 on which a photoconductive layer 63 is formed. The conductive layer 62 of the drum 58 is connected to ground; on the other hand, to the conductive layer 64 of the developing roller 56 is applied an a.c. voltage supplied from a power supply 65 so as to cause the toner particles to fly over the gap. With such an arrangement, an a.c. electric field is produced in the gap between the electrode layer 64 of the developing roller 56 and the conductive layer 62 of the drum 58 so that the charged toner particles on the developing roller 56 are selectively caused to fly over the gap, thereby developing an electrostatic latent image formed on the drum 58. In this instance, since the developing roller 56 is set in oscillation, the toner particles carried by the roller 56 are also subjected to such oscillation, and, thus, the toner particles are made easy to fly as separated from the developing roller 56. Once the toner particles are separated away from the developing roller 56, they are electrostatically attracted by the electric field emanating from the latent image formed on the drum 58. In this manner, since the toner particles are more easily separated from the developing roller 56 thanks to the application of oscillation thereto, the level of the voltage applied to the developing roller 56 can be lowered. Alternatively, for the purpose of causing the toner particles to fly across the developing gap, a pulse voltage or an a.c. voltage superposed with a d.c. voltage can be applied to the developing roller 56 other than a simple a.c. voltage.

As described above, since the application of oscillation to the developing roller 56 contributes for the toner particles to be easily separated from the developing roller 56 when drawn by the electric field emanating from an electrostatic latent image, it is possible to carry out practical development while applying a d.c. voltage same in polarity as the toner particles to the developing roller 56. This is also important because use of such a d.c. developing bias is advantageous because it prevents the toner particles once transferred to the latent image on the drum 58 from returning to the developing roller 56. On the other hand, in the case of using an a.c. developing bias, the toner particles can move back and forth across the developing roller 56 and the drum 56.

It is further to be noted that, in the embodiment illustrated in FIG. 10, the developing roller 56 is structured to be elastically deformable as described previously. That is, the developing roller 56 includes a rotating shaft 66, an elastic layer 67 formed on the shaft 66, an electrically conductive layer 64 formed on the elastic layer 67, and a surface layer 68 formed on the conductive layer 64. The elastic layer 67 is preferably comprised of rubber or a foam material, such as sponge or urethane. In the illustrated embodiment, the conductive layer 64 and the surface layer 68 are comprised of a rigid material, but they may also be comprised of an appropriate elastic material.

In the case of the developing roller 56 shown in FIG. 10, in order to attain an enhanced flying characteristic for the toner particles, the amplitude at the surface of the developing roller 56 is made smaller than the gap between the roller 56 and the drum 58 and the frequency of oscillation is preferably set at 50 cycles or above, and most preferably at 200 cycles or above. If the frequency of oscillation is set in an ultrasonic range, i.e., $1.6\times10^4$ cycles or above, then there is produced no audible sound so that there is no noise problem.

Furthermore, if the toner particles are mixed with fine powder of an inorganic compound which are smaller in size than the toner particles, such fine powder contributes to increase the fluidic nature of the toner particles so that the toner particles can be made much easier to be separated from the developing roller 56 when they fly and also they are effectively prevented from being stuck to the developing roller 56 and/or the blade 57. Such fine powder is preferably comprised of $SiO_2$, SiC, or the like, and the preferred mixture ratio is 0.1% to 10% by weight. If the fine powder is mixed at such a mixture ratio, even if use is made of toner particles having the average diameter of 7 microns or less, the non-contact development can be carried out efficiently so that there is obtained a developed image high in quality.

In the illustrated embodiment, the surface layer 68 of the developing roller 56 includes an inner dielectric layer 69 and an outer electrode dispersion layer 71 comprised of a dielectric matrix material and a number of fine electrodes 70 dispersed in the matrix material. The electrodes 70 are electrically isolated one from another and from the conductive layer 64 so that they define floating electrodes. It is to be noted that the surface layer 68 can be discared, if desired.

There are various other alternative means for imparting oscillation to the developing roller 56. For example, a piezo-electric element, such as a bimorph element, may be provided in the developing roller 56 so as to impart vibration thereto. FIG. 12 shows one such example. As shown, the elastic layer 67 is formed on the rotating shaft 66 and a piezo plastic element 72 is wrapped around the elastic layer 67, on which is also provided the electrically conductive layer 64 and the surface layer 68. Although not shown, the piezo plastic element 72 is sandwiched between a pair of electrodes to which an a.c. or pulsed driving voltage is applied, whereby the piezo plastic element 72 expands and contracts alternately in the longitudinal direction normal to its thickness direction so that oscillation is imparted to the developing roller 56, in particular to its peripheral surface defined by the surface layer 68. It should be noted that such a piezo electric element can also be provided at an outermost layer of the developing roller 56. As a further modification of the oscillation imparting means, use may also be made of an eccentric cam which is provided to be in rolling contact with the peripheral surface of the developing roller 56. Other oscillation imparting means includes those utilizing alternating or stationary magnetic field.

Figure 13:
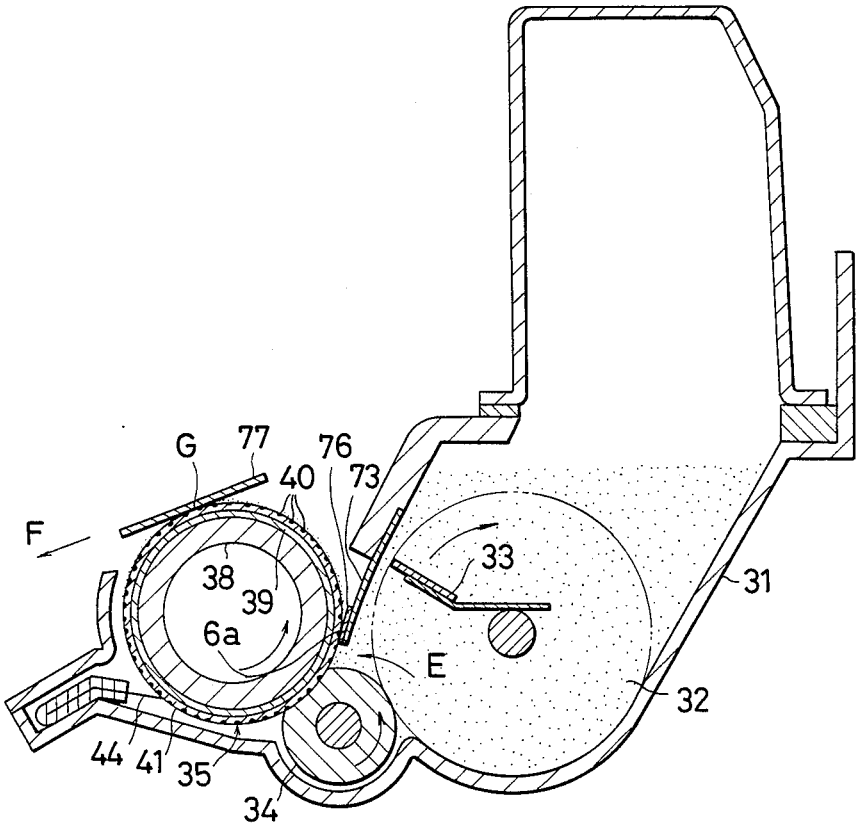
FIG. 13 is a schematic illustration showing a developing device constructed in accordance with a still further embodiment of the present invention and including a doctor blade comprised of a copolymer of ethylene and tetrafruoroethylene.

Now, a still further aspect of the present invention will be described below with particular reference to FIGS. 13 through 20. This aspect of the present invention has a feature of forming a doctor blade from a copolymer of ethylene and tetrafluoroethylene at least partly. It is to be noted that the developing device embodying this aspect of the present invention as shown in FIG. 13 is similar in many respects to the developing device shown in FIG. 9 and described previously, so that like numerals are used to indicate like elements in FIG. 13. That is, the developing device of FIG. 13 also includes the developing roller 35, which is in the form of cylinder or sleeve as different from that of FIG. 9. The toner particles 32 stored in the hopper 31 are mixed and transported to the toner supply roller 34 by the agitator 33 and then the toner particles are charged and thus electrostatically attracted to the developing sleeve 35 due to the scrubbing action between the toner supply roller 34 and the developing sleeve 35. The toner particles 32 are then carried on the developing roller 35 to move past the contact point between the developing roller 35 and a film thickness regulating member 76 fixedly mounted on a support plate 73. Since the film thickness regulating member 76 is normally pressed against the developing roller 35, the toner particles are formed into a thin film properly charged and regulated in thickness. Such a thin film of toner particles are then used for development at the developing region G where a photosensitive member 77 bearing thereon an electrostatic latent image also passes through in the direction indicated by the arrow F.

In the illustrated embodiment, the developing roller 35 includes an electrically conductive support 38 which also serves as an opposite electrode with respect to an electrostatic latent image formed on the photosensitive member 77, an electrically insulating layer 39 formed on the support 38, and an electrode dispersion layer 41 having dispersion of a number of fine electrodes 40 and formed on the insulating layer 39.

The film thickness regulating member 76 is formed in the shape of a blade and is fiexly mounted on the support plate 73 which is fixedly attached to the housing of the device. The member 76 has a forward edge **76*a* is pressed against the developing roller 35 so that the amount of the toner particles to be transported as carried on the developing roller 35 is regulated and thus its film thickness is also regulated. It has been experimentally found that, if the member 76 is comprised of a fluorine-containing material, such as a copolymer of tetrafluoroethylene and hexafluoropropylene (FEP), a tetrafruoroethylene-perfluoroalkylvinyleether copolymer resin (PFA), tetrafluoroethylene resin (PTFE), or trifluorochloroethylene (PCTFE), the toner particles are prevented from being stuck on the member 76 and yet they are suitably charged. It has also been found that the member comprised of such a material is relatively inferior in wear-resistance, and, thus, the member 76 tends to wear sooner, thereby deteriorating the charging and thickness regulating functions. It has also been found that, if the member 76** is comprised of a copolymer which belongs to the fluorine-containing family and which possesses the following fundamental structure,

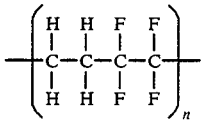

the toner particles can be charged efficiently without occurrence of toner sticking, and, yet, the wear can be minimized, thereby permitting a stable long-term use. As a result, it is preferable to form the film thickness regulating member 76 from a copolymer of ethylene and tetrafluoroethylene, and most preferably from such a copolymer of ethylene and tetrafluoroethylene having the copolymerization ratio of 1:1. Such a copolymer is sold by Asahi Glass Co. of Japan under the tradename of AFLON COP which includes various grades classified as C-55A, C-88A, C-55AX, CF-8025, C1FB-8050, CF-5020, and CF-8011. Among these various grades, C-55A, C-88A and C-88AX are particularly suitable. It might be of value to note in passing that a product manufactured in the form of a film from this material is also available by the tradename of AFLEX. The film thickness regulating member 76 formed from such a material is elastic in nature so that it can be pressed against the developing roller 35 uniformly, which then allows to obtain a thin film of charged toner particles extremely uniform in thickness.

Figure 14:
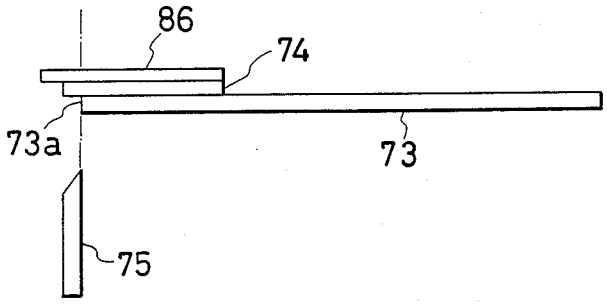
FIGS. 14 through 20 are schematic illustrations showing various modifications of the doctor blade applicable to the developing device shown in FIG. 13.
Figure 15:
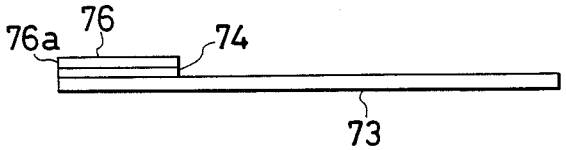

There are various ways to manufacture the film thickness regulating member 76 using the above-described materials, and several typical examples will be described below. As shown in FIG. 14, there is prepared the support member 73 in the shape of a film or sheet, and a film thickness regulating member 86 in the form of a film and comprised of the before-mentioned copolymer (AFLEX by tradename) is fixedly attached using a both-sided adhesive tape or an adhesive 74. In this case, the member 86 and the tape 74 are extended beyond the end surface **73*a* of the support member 73 and the extended portions are severed by a knife 75 along the end surface 73*a* of the support member 73 as indicated by the one-dotted line. In this manner, there is obtained the film thickness regulating member 76 having the edge 76*a* at a desired angle, as shown in FIG. 15**.

Figure 16:
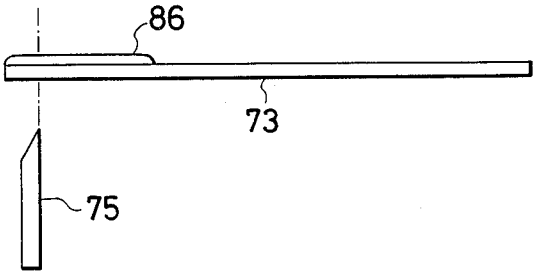

On the other hand, as shown in FIG. 16, there is prepared the support member 73 in the form of film or sheet, and then the before-mentioned copolymer material in the form of liquid sold under the tradename of AFLON COP 86 is coated. Then, after hardening, the material 86 and the support member 73 are severed by the knife 75 along the line indicated by the one-dotted line, thereby completing the desired regulating member 76, as shown in FIG. 15. Burrs may be formed at the edge when severed, if which case the cutting surface may be ground to remove the burrs. It is to be noted that the desired structure can be obtained only by grinding instead of severing.

Figure 17:
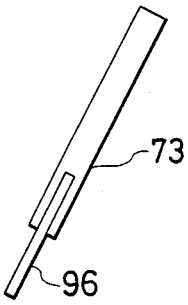
Figure 18:
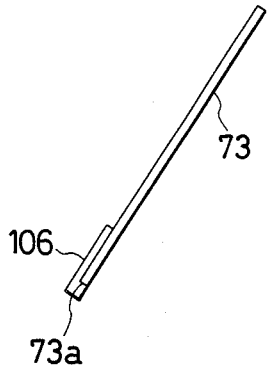
Figure 19:
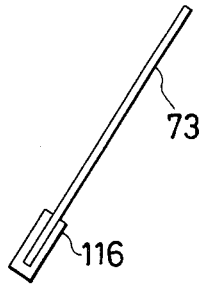

The film thickness regulating member 76 may be supported in position in various manners. For example, as shown in FIG. 17, the support member 73 may be provided with a recess at its bottom end, in which a film thickness regulating member 96 may be fixedly fitted. In the case where the film thickness regulating member 76 is fixedly attached to one surface of the support member 73 as shown in FIG. 13 and the support member 73 is comprised of a metal or the like, the toner particles do not stick to the regulating member 76 but the toner particles stick to the forward end of the metal support member 73 which could cause deterioration in performance. Accordingly, in an embodiment shown in FIG. 18, a film thickness regulating member 106 is so provided to cover the forward end surface 73*a* of the support member 73, in which case the toner particles are prevented from being stuck at the forward end of the support member 73. FIG. 19 shows a further embodiment in which a film thickness regulating member 116 is so provided to cover a forward end portion of the support member 73. In this case, not only the forward end of the support member 73, but also forward portions on opposite surfaces of the support member 73 are equally covered by the regulating member 116. With this structure, even if there is a difference in thermal expansion coefficient between the support member 73 and the regulating member 116, a thermal deformation can be minimized.

Figure 20:
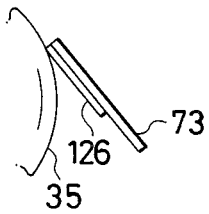

FIG. 20 shows a still further embodiment in which a film thickness regulating member 126 is formed on the support member 73 and the support member 73 is disposed in a trailing direction so that the regulating member 126 extends in the same direction as the moving direction of the developing roller 35 at the point of contact.

When manufacturing the regulating member 76, use may also be made of a ethylene-tetrafluoroethylene copolymer added with a filler material, such as carbon black, graphite, glass fiber, carbon fiber, silica, $Fe_2O_3$, or $MoS_2$. If an electrically conductive filler material is added, the resulting film thickness regulating member 76 is made electrically conductive, so that this member 76 can also be used to remove charge from the fine electrodes 40 in the developing roller 35. It should also be noted that the regulating member 76, 86, 96, 106, or 116 is not necessary to be comprised of such a material in its entirety, and it is only necessary that that portion of the regulating member which is brought in to scrubbing contact with the developing roller 35 is comprised of such a material.

In the following, typical experimental results will be summarized. In the experiments, use was made of materials (1) PFA, (2) 4F, (3) PE, and (4) AFLEX of 100 microns thick. The experimental conditions were as follows:

(I) Peripheral Speed of Photosensitive Drum:
* 120 mm/sec.

(II) Developing Roller:
* 25.4 mm in diameter
* 400 r.p.m.
* direction of movement same with the drum at the contact point (III) Sponge Roller
* 800 r.p.m.
* direction of movement opposite to the developing roller at the contact point (IV) Agitator
* 2 vanes
* 80 r.p.m.
* direction of rotation opposite to the sponge roller Under the above-described conditions, the developing operations were repetitively carried out using the above-listed four materials (1) through (4), and the following findings were obtained.

(1) PFA

Black streaks were produced in the background area approximately after 3,000 copies. Wear of the film thickness regulating member was found by microscopic observation.

(2) 4F

Black streaks were produced in the background area approximately after 2,500 copies. Wear of the film thickness regulating member was found by microscopic observation.

(3) PE

Fog was formed in the background area after 1,500 copies. Slight toner sticking occurred at the forward end of the film thickness regulating member.

(4) AFLEX

Excellent images were obtained through 10,000 copies.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for developing an electrostatic latent image, comprising:

storing means for storing a quantity of a developer;

transporting means for transporting said developer along a predetermined path which passes thorugh a developing region where said latent image is developed by said developer, said predetermined path including a curved region having a predetermined radius of curvature;

supplying means for supplying said developer stored in said storing means to said transporting means to thereby cause said developer to be attracted to said transporting means electrostatically;

a doctor blade located downstream of said supplying means with respect to a direction of transporting said developer by said transporting means along said predetermined path, wherein said doctor blade is pressed against said transporting means at said curved region and extends in a direction opposite to the transporting direction of said developer at a contact point between said doctor blade and said transporting means, and wherein when said radius of curvature is at least 3 mm, said doctor blade is arranged such that a separating distance between said transporting means and said blade along a straight line normal to a tangential line drawn at a point 1 mm downstream from said contact point between said transporting means and said blade is at least 0.3 mm.

2. The device of claim 1 wherein said transporting means includes a developing sleeve which is driven to rotate in a first direction so that said radius of curvature is a radius of said sleeve.

3. The device of claim 2 wherein said supplying means includes a supply roller which is in contact with said developing sleeve and is driven to rotate to establish a scrubbing contact with said developing sleeve and to thereby cause said developer to be electrically charged at said scrubbing contact and electrostatically attracted to said developing sleeve.

4. The device of claim 3 wherein said developing sleeve includes an electrically conductive layer, a dielectric layer formed on said conductive layer, and an electrode layer formed on said dielectric layer, said electrode layer including a dielectric matrix material and a plurality of fine electrodes dispersed in said matrix material and electrically isolated one from another.

5. The device of claim 4 further comprising bias applying means for applying a predetermined bias voltage to said electrically conductive layer of said developing sleeve.

6. The device of claim 5 further comprising charge removing means disposed downstream of said developing region but upstream of said supplying means with respect to the transporting direction of said developer, said charge removing means being in contact with the peripheral surface of said developing sleeve for removing residual charge therefrom.

7. The device of claim 3 wherein said supply roller includes a sponge layer at its outermost layer.

8. The device of claim 1 wherein said blade includes a material excellent in parting characteristic with said developer at least partly where in contact with said transporting means.

9. The device of claim 8 wherein said material excellent in parting characteristic is a fluorine-containing material.

10. A device for developing an electrostatic latent image with developer which is electrostatically attracted to and held on transporting means, comprising:

storing means for storing a quantity of a developer;

transporting means for transporting said developer along a predetermined path which passes through a developing region where said latent image is developed by said developer, said predetermined path including a curved region having a predetermined radius of curvature;

supplying means for supplying said developer stored in said storing means to said transporting means, wherein said developer supplied to the transporting means is attracted thereto electrostatically and is transported thereby along a transporting direction to the developing region while remaining attracted electrostatically to the transporting means;

a doctor blade having a portion pressed against the transporting means at a contact point which is located downstream of said supplying means with respect to the transporting direction, wherein said doctor blade extends in a direction away from the transporting direction from said contact point and wherein when said radius of curvature is at least 3 mm, the separation between said doctor blade and said transporting means along a straight line normal to a tangential line drawn at a point 1 mm downstream from said contact point is at least 0.3 mm.

* * * * *